US010125447B2

(12) United States Patent
Benson et al.

(10) Patent No.: US 10,125,447 B2
(45) Date of Patent: Nov. 13, 2018

(54) STAIN TREATMENT DEVICE AND PROCESS

(71) Applicant: Conopco, Inc., Englewood Cliffs, NJ (US)

(72) Inventors: Paul Benson, Chester (GB); Stuart Stephen Cooley, Wirral (GB); Elizabeth Jane Smith, Chester (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 157 days.

(21) Appl. No.: 14/899,136

(22) PCT Filed: Jun. 6, 2014

(86) PCT No.: PCT/EP2014/061863
§ 371 (c)(1),
(2) Date: Dec. 17, 2015

(87) PCT Pub. No.: WO2014/206712
PCT Pub. Date: Dec. 31, 2014

(65) Prior Publication Data

US 2016/0145791 A1 May 26, 2016

(30) Foreign Application Priority Data

Jun. 27, 2013 (EP) ..... 13174148

(51) Int. Cl.
*D06F 39/02* (2006.01)
*C11D 3/386* (2006.01)
(Continued)

(52) U.S. Cl.
CPC ..... *D06F 39/02* (2013.01); *C11D 3/386* (2013.01); *C11D 3/38627* (2013.01);
(Continued)

(58) Field of Classification Search
CPC ..... D06F 39/02; D06F 39/024; C11D 17/046
See application file for complete search history.

(56) References Cited

U.S. PATENT DOCUMENTS 6,213,665 B1 4/2001 Degoix et al.
6,523,371 B1 2/2003 Sherratt et al.
(Continued)

FOREIGN PATENT DOCUMENTS

CN 1239873 12/1999
CN 1288496 3/2001
(Continued)

OTHER PUBLICATIONS

IPRP2 in PCTEP2014061863 dated Sep. 24, 2015. pp. 1 to 6.
(Continued)

*Primary Examiner* — Spencer E Bell
(74) *Attorney, Agent, or Firm* — Foley & Lardner LLP

(57) ABSTRACT

A fabric stain treatment device for treating a stain on a fabric with a fabric stain treatment composition during a fabric washing process, the fabric stain treatment device comprising: (a) a storage chamber for storing the fabric stain treatment composition, said storage chamber comprising two adjacent convex walls in a stacked arrangement with an upper wall and an lower wall; and a waist portion; (b) a filling and dispensing aperture defined by one or more upper edge portions of the storage chamber, said edge portion/s comprising a pour spout; and (c) a base the periphery of which is contiguous with the lower wall; said base and lower wall interconnecting at a base edge portion at least one annular scrubbing portion on a base edge portion.

12 Claims, 1 Drawing Sheet

Figure 1:
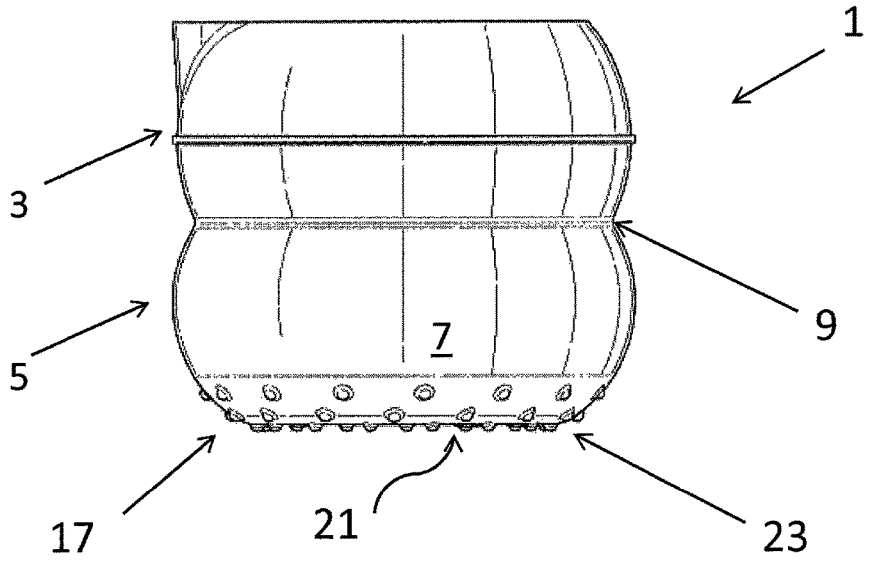

(51) Int. Cl.

| | |
|---|---|
| ***D06F 39/12*** | (2006.01) |
| ***C11D 17/04*** | (2006.01) |
| ***C11D 11/00*** | (2006.01) |

(52) U.S. Cl.

CPC ..... *C11D 3/38636* (2013.01); *C11D 3/38645* (2013.01); *C11D 3/38654* (2013.01); *C11D 11/0017* (2013.01); *C11D 17/046* (2013.01); *D06F 39/024* (2013.01); *D06F 39/12* (2013.01)

(56) References Cited

U.S. PATENT DOCUMENTS

| | | | | |
|---|---|---|---|---|
| 6,832,867 | B2 | 12/2004 | Sandbach et al. | |
| 9,033,606 | B2 | 5/2015 | Turchi et al. | |
| 2002/0056165 | A1* | 5/2002 | Deflander | A47L 25/08 8/158 |
| 2003/0104962 | A1* | 6/2003 | Verherbrugghen | A47L 25/08 510/296 |
| 2008/0178637 | A1 | 7/2008 | Etesse | |
| 2014/0182067 | A1 | 7/2014 | Di Bono et al. | |
| 2014/0196219 | A1* | 7/2014 | Di Bono | D06F 39/02 8/137 |

FOREIGN PATENT DOCUMENTS

| | | |
|---|---|---|
| CN | 1313916 | 9/2001 |
| CN | 2486575 | 4/2002 |
| CN | 1347470 | 5/2002 |
| CN | 1360627 | 7/2002 |
| CN | 101319450 | 12/2008 |
| CN | 103534401 | 1/2014 |
| CN | 103620104 | 3/2014 |
| EP | 2527512 | 11/2012 |
| WO | WO9816148 | 4/1998 |
| WO | WO9937849 | 7/1999 |
| WO | WO2004057088 | 7/2004 |
| WO | WO09156317 | 12/2009 |
| WO | WO2009156317 | 12/2009 |
| WO | WO2012175987 | 12/2012 |

OTHER PUBLICATIONS

Search Report in EP13174148 dated Nov. 27, 2013. pp. 7 to 8.
Search Report in PCTEP2014061863 dated Jul. 7, 2014. pp. 9 to 11.
Written Opinion 1 in PCTEP2014061863 dated Jul. 9, 2014. pp. 12 to 16.
Written Opinion in PCTEP2014061863 dated Jun. 16, 2015. pp. 17 to 21.
Written Opinion in EP13174148 dated Nov. 27, 2013. pp. 22 to 23.

* cited by examiner

STAIN TREATMENT DEVICE AND PROCESS

The present invention concerns a fabric stain treatment device and fabric stain treatment process for a washing process.

An objective is to provide an improved washing process with improved stain removal without the need for additional devices.

According to a first aspect of the present invention there is provided a fabric stain treatment device for treating a stain on a fabric with a fabric stain treatment composition during a fabric washing process, the fabric stain treatment device comprising:

(a) a storage chamber for storing the fabric stain treatment composition, said storage chamber comprising two adjacent convex walls in a stacked arrangement with an upper wall and an lower wall; and a waist portion;

(b) a filling and dispensing aperture defined by one or more upper edge portions of the storage chamber, said edge portion/s comprising a pour spout; and (c) a base the periphery of which is contiguous with the lower wall; said base and lower wall interconnecting at a base edge portion at least one annular scrubbing portion on a base edge portion.

According to a second aspect of the present invention there is provided a process for treating fabric stains with a fabric stain treatment composition during a fabric washing process comprising the steps of:

(a) charging with the fabric stain treatment composition, the stain treatment device of the first aspect of the invention;

(b) pouring at least a portion of the fabric stain treatment composition from the stain treatment device on to a fabric stain via the pour spout;

(c) holding the stain treatment device at the waist portion and scrubbing the fabric with the annular scrubbing portion and then optionally, (d) placing the device and the remaining composition and the fabric into a washing machine to undergo a washing process therein.

According to a third aspect of the present invention there is provided a fabric stain treatment kit comprising:

(a) a fabric stain treatment composition comprising one or more enzymes (b) the device of the first aspect of the invention; and (c) instructions to treat a fabric stain using the device and the composition according to the method of the second aspect.

With the invention, stain treatment can be affected by a device which also functions as a dosing device to be inserted into a washing machine.

The adjacent convex walls in a stacked arrangement comprise an upper wall and an lower wall when the device is observed on a level surface.

The term "stacked" as used herein it is intended to mean with one wall portion on top of the other in upright orientation when the fabric stain treatment device is placed with its base on a substantially level surface.

Preferably the upper and lower walls have substantially common convex curvature when viewed from a side. Preferably the adjacent wall converge to co-join each other thereby defining a curved cleft indentation in at least the outer surface of the storage chamber (when viewed from the side) thereby providing said waist portion. The cleft may have an apex where the walls meet and co-join.

With such an arrangement, the general outer shape of the fabric treatment device may be in the form stacked, truncated spheres wherein said truncation is by removal of opposing upper and lower spherical caps.

The cleft may be deeply curved such that the co-joining is at a cusp. The cusp, when viewed from the side, preferably comprises a point or portion where the curves of each of said wall portion share or tend toward a common level tangent. When viewed from the side with the device on a level surface the common tangent is preferably level.

The advantage of the curved cleft this is that as the users' fingers intuitively grasp the waist portion they are encouraged by the curvature to move toward the peak or apex of the cleft and the convexity of the two walls provides a gripping action which acts against release or slide from the position. This feature is helpful in wet/slippery conditions as is often the case in a domestic laundering situation.

A further particular advantage is that when the device is used in the second aspect of the device the user can grip the device securely during the scrubbing step.

Preferably the fabric stain treatment device comprises a resilient e.g. elastomeric material or the like, to enhance the gripping action afforded by the stacked wall portions.

Preferably the storage chamber comprises an inner surface of the fabric stain treatment device which mirrors the outer surface. In the case of stacked convex walls as herein defined, the advantage is that the inner surfaces are concave relative to any stored composition and so act to contain the composition. Preferably there is at least one internally projecting edge portion provided by the cleft. This assists in deflecting any fluid back into the device during pretreatment when the device is tipped/moved back and forth in scrubbing. Preferably there is a second internally projecting edge portion in the at least one upper wall which even further enhances the anti-spillage performance of the device.

The device may be translucent or transparent. This can be advantageous in that it allows more light into parts of the interior of the device which have diminished direct light e.g. around the internally projecting edge portion so that the fill-level of the composition can be ascertained.

The fabric treatment device comprises a base, the periphery of which is contiguous with the lower wall; said base and lower wall interconnecting at a base edge portion.

Preferably the or each annular scrubbing portion is provided on said base edge portion. Preferably the or each annular scrubbing portion extends around the entire circumference of the base edge portion so scrubbing may effected by any part of the edge. The provision of a scrubbing portion on a edge portion allows for precise scrubbing as can be required with small food stains. This is especially advantageous for minor (small) stains which have red colouration such as red food stains, e.g. tomatoes and berries. Minor stains of lighter colours are easier dealt with and less dramatic. However one single red-coloured stain can entirely ruin a whole white garment. The device affords precise treatment of small, red-coloured food stains without the need for a separate, dedicated often expensive stain treatment device such as a stain pen.

The presence of the or each annular scrubbing portion on the base edge portion allows for a small amount of tilting of the device to bring the scubbing portion into play. It also however allows for no or at least minimal scrubbing when the device is not tilted but held level. It also restricts scrubbing to that part of the fabric that the user can actually see whilst scrubbing, should the user want to scrub only the parts of the fabric bearing the stain.

Accordingly the method of the invention may include tilting the stain treatment device prior to scrubbing the fabric with the projections.

The or each annular scrubbing portion may extend into the lower wall and/or base portion.

The scrubbing portion may comprise one or more raised areas or projections, such dots, ribs, or any other suitable shape.

Preferably the base comprises a central concave (viewed externally of the device from a bottom plan view) portion such that the base edge portion is more defined visually and/or structurally. Preferably the concave base portion has a smooth surface. This also can restrict unwanted scrubbing by the concave part of the base portion.

Preferably the fabric stain treatment device is generally symmetrical about any upright plane passing through the longitudinal axis of the device. It may also be symmetrical about a level plane passing through the cleft (or in the case of a cusp, through the above mentioned common tangent).

Preferably the fabric stain treatment composition comprises one or more enzymes.

The one or more enzymes may comprise any one or combination of the following enzymes. Enzymes may be from bacterial or fungal origin. Chemically modified or protein engineered mutants are included. As used herein the term "enzyme" includes enzyme variants (produced, for example, by recombinant techniques) are included. Examples of such enzyme variants are disclosed, e.g., in EP 251,446 (Genencor), WO 91/00345 (Novo Nordisk), EP 525,610 (Solvay) and WO 94/02618 (Gist-Brocades N V).

Preferably the one or more enzymes comprise pectate lyase. This is especially advantageous in combination with the scrubbing portion/s located on the circumferential edge portion for treating red-coloured e.g. fruit based stains.

Preferred pectate lyases include pectate lyases that are derived/cloned from bacterial genera such as *Erwinia, Pseudomonas, Klebsiella* and *Xanthomonas*, as well as from *Bacillus subtilis* (Nasser et al. (1993) FEBS Letts. 335:319-326) and *Bacillus* sp. YA-14 (Kim et al. (1994) Biosci. Biotech. Biochem. 58:947-949); *Bacillus pumilus* (Dave and Vaughn (1971) J. Bacteriol. 108:166-174), *B. polymyxa* (Nagel and Vaughn (1961) Arch. Biochem. Biophys. 93:344-352), *B. stearothermophilus* (Karbassi and Vaughn (1980) Can. J. Microbiol. 26:377-384), *Bacillus* sp. (Hasegawa and Nagel (1966) J. Food Sci. 31:838-845) and *Bacillus* sp. RK9 (Kelly and Fogarty (1978) Can. J. Microbiol. 24:1164-1172. Divalent cation-independent and/or thermostable pectate lyases may be used.

Examples of commercially available alkaline pectate lyases include BIOPREP™ and SCOURZYME™ L from Novozymes A/S, Denmark.

Preferably, the one or more enzymes comprise proteases and/or glycosidases and/or pectate lyases.

Preferred proteases include serine protease or a metallo protease, preferably an alkaline microbial protease or a trypsin-like protease. Alkaline proteases include subtilisins, especially those derived from *Bacillus*, e.g., subtilisin Novo, subtilisin Carlsberg, subtilisin 309, subtilisin 147 and subtilisin 168. Trypsin-like (i.e. capable of cleaving peptide bonds at the C-terminal side of lysine or arginine.) Such proteases may be of porcine or bovine origin. *Fusarium* derived trypsin proteases are also included.

Commercially available protease enzymes include Alcalase™, Savinase™, Primase™, Duralase™, Dyrazym™, Esperase™, Everlase™, Polarzyme™, and Kannase™ (Novozymes A/S), Maxatase™, Maxacal™, Maxapem™, Properase™, Purafect™ Purafect OxP™, FN2™, and FN3™ (Genencor International Inc.).

Preferred lipases include lipases from *Humicola* (synonym *Thermomyces*), e.g. from *H. lanuginosa* (*T. lanuginosus*) or from *H. insolens*, a *Pseudomonas* lipase, e.g. from *P. alcaligenes* or *P. pseudoalcaligenes, P. cepacia, P. stutzeri, P. fluorescens, Pseudomonas* sp. strain SD 705 (WO 95/06720 and WO 96/27002), *P. wisconsinensis*, a *Bacillus* lipase, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Commercially available lipase enzymes include Lipolase™ and Lipolase Ultra™, Lipex™ (Novozymes A/S).

Preferred Phospholipases (EC 3.1.1.4 and/or EC 3.1.1.32) include enzymes which hydrolyse phospholipids. Phospholipases $A_1$ and $A_2$ which hydrolyze one fatty acyl group (in the sn-1 and sn-2 position, respectively) to form lysophospholipid; and lysophospholipase (or phospholipase B) which can hydrolyze the remaining fatty acyl group in lysophospholipid are included as are Phospholipase C and phospholipase D (phosphodiesterases) which release diacyl glycerol or phosphatidic acid respectively.

The term "phospholipase A" used herein in connection with an enzyme of the invention is intended to cover an enzyme with Phospholipase $A_1$ and/or Phospholipase $A_2$ activity. The phospholipase activity may be provided by enzymes having other activities as well, such as, e.g., a lipase with phospholipase activity.

The phospholipase may be of any origin, e.g., of animal origin (such as, e.g., mammalian), e.g. from pancreas (e.g., bovine or porcine pancreas), or snake venom or bee venom. Preferably the phospholipase may be of microbial origin, e.g., from filamentous fungi, yeast or bacteria, such as the genus or species *Aspergillus*, e.g., *A. niger; Dictyostelium*, e.g., *D. discoideum; Mucor*, e.g. *M. javanicus, M. mucedo, M. subtilissimus; Neurospora*, e.g. *N. crassa; Rhizomucor*, e.g., *R. pusillus; Rhizopus*, e.g. *R. arrhizus, R. japonicus, R. stolonifer, Sclerotinia*, e.g., *S. libertiana; Trichophyton*, e.g. *T. rubrum; Whetzelinia*, e.g., *W. sclerotiorum; Bacillus*, e.g., *B. megaterium, B. subtilis; Citrobacter*, e.g., *C. freundii; Enterobacter*, e.g., *E. aerogenes, E. cloacae Edwardsiella, E. tarda; Erwinia*, e.g., *E. herbicola; Escherichia*, e.g., *E. coli; Klebsiella*, e.g., *K. pneumoniae; Proteus*, e.g., *P. vulgaris; Providencia*, e.g., *P. stuartii; Salmonella*, e.g. *S. typhimurium; Serratia*, e.g., *S. liquefasciens, S. marcescens; Shigella*, e.g., *S. flexneri; Streptomyces*, e.g., *S. violeceoruber; Yersinia*, e.g., *Y. enterocolitica*. Thus, the phospholipase may be fungal, e.g., from the class *Pyrenomycetes*, such as the genus *Fusarium*, such as a strain of *F. culmorum, F. heterosporum, F. solani*, or a strain of *F. oxysporum*. The phospholipase may also be from a filamentous fungus strain within the genus *Aspergillus*, such as a strain of *Aspergillus awamori, Aspergillus foetidus, Aspergillus japonicus, Aspergillus niger* or *Aspergillus oryzae*.

Preferred phospholipases are derived from a strain of *Humicola*, especially *Humicola lanuginosa* or variant; and from strains of *Fusarium*, especially *Fusarium oxysporum*. The phospholipase may be derived from *Fusarium oxysporum* DSM 2672.

Preferably phospholipases comprise a phospholipase $A_1$ (EC. 3.1.1.32). or a phospholipase $A_2$ (EC.3.1.1.4.).

Examples of commercial phospholipases include LECITASE™ and LECITASE™ ULTRA, YIELSMAX, or LIPOPAN F (available from Novozymes A/S, Denmark).

Preferred cutinases (EC 3.1.1.74.) are derived from a strain of *Aspergillus*, in particular *Aspergillus oryzae*, a strain of *Alternaria*, in particular *Alternaria brassiciola*, a strain of *Fusarium*, in particular *Fusarium solani, Fusarium solani pisi, Fusarium roseum culmorum*, or *Fusarium roseum* sambucium, a strain of *Helminthosporum*, in particular *Helminthosporum sativum*, a strain of *Humicola*, in particular *Humicola insolens*, a strain of *Pseudomonas*, in particular *Pseudomonas mendocina*, or *Pseudomonas putida*, a strain of *Rhizoctonia*, in particular *Rhizoctonia solani*, a strain of *Streptomyces*, in particular *Streptomyces* scabies, or a strain of *Ulocladium*, in particular *Ulocladium consortiale*. Most preferably cutinase is derived from a strain of *Humicola insolens*, in particular the strain *Humicola insolens* DSM 1800.

Commercial cutinases include NOVOZYM™ 51032 (available from Novozymes A/S, Denmark).

Preferred amylases (alpha and/or beta) are included for example, alpha-amylases obtained from *Bacillus*, e.g. from strains of *B. licheniformis* NCIB8059, ATCC6634, ATCC6598, ATCC11945, ATCC 8480, ATCC9945a, or the *Bacillus* sp. strains DSM 12649 (AA560 alpha-amylase) or *Bacillus* sp. DSM 12648 (AA349 alpha-amylase). Commercially available amylases are Duramyl™, Termamyl™, Termamyl Ultra™ Natalase™, Stainzyme™, Fungamyl™ and BAN™ (Novozymes A/S), Rapidase™ and Purastar™ (from Genencor International Inc.).

Preferred cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum*.

Especially preferred cellulases are the alkaline or neutral cellulases having color care benefits. Commercially available cellulases include Celluzyme™, Carezyme™ Endolaser™, Renozyme™ (Novozymes A/S), Clazinase™ and Puradax HA™ (Genencor International Inc.), and KAC-500 (B)™ (Kao Corporation).

Preferred mannanases (EC 3.2.1.78) include derived from a strain of the filamentous fungus genus *Aspergillus*, preferably *Aspergillus niger* or *Aspergillus aculeatus* or *Trichoderma* reseei or from the *Bacillus* microorganism FERM P-8856 which produces beta-mannanase and beta-mannosidase or from alkalophilic *Bacillus* sp. AM-001 or from *Bacillus amyloliquefaciens*. The mannanase may comprise alkaline family 5 and 26 mannanases derived from *Bacillus agaradhaerens, Bacillus licheniformis, Bacillus halodurans, Bacillus clausii, Bacillus* sp., and *Humicola insolens*.

Examples of commercially available mannanases include Mannaway™ available from Novozymes A/S Denmark.

Preferred peroxidases/oxidases include peroxidases from *Coprinus*, e.g. from *C. cinereus*, and variants thereof. Commercially available peroxidases include Guardzyme™ and Novozym™ 51004 (Novozymes A/S).

The enzymes may be the sole fabric treatment agent or other stain removal agents may be incorporated.

Any enzyme present in a composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid.

According to a further aspect of the invention there is provided use of a fabric stain treatment device of the first aspect of the invention in combination with one or more enzymes, preferably a pectate lyase in the treatment of stains, preferably red-coloured stains, on a fabric in a washing process of the second aspect of the invention.

Other detergent ingredients may be included including surfactants, builders, sequestring agents, hydrotropes, preservatives, complexing agents, polymers, stabilizers, perfumes, optical brighteners, or other ingredients such as e.g. fabric conditioners including clays, foam boosters, suds suppressors (anti-foams), anti-corrosion agents, soil-suspending agents, anti-soil redeposition agents, anti-microbials, tarnish inhibitors, or combinations of one or more thereof, provided that these ingredients are compatible with the enzymes.

The fabric wash compositions may comprise a fabric wash detergent material selected from non-soap anionic surfactant, nonionic surfactants, soap, amphoteric surfactants, zwitterionic surfactants and mixtures thereof. The surfactants may be present in the composition at a level of from 0.1% to 60% by weight.

The fabric wash composition may comprise any flowable and pourable composition, e.g. liquid, gel, powder, powder-liquid mixture.

Preferably the viscosity is in the range 200-1500 cPs at $21^{-1}$. Preferably the viscosity is measured at room temperature (21 degrees) using a Brookfield Viscometer.

Figure 2:
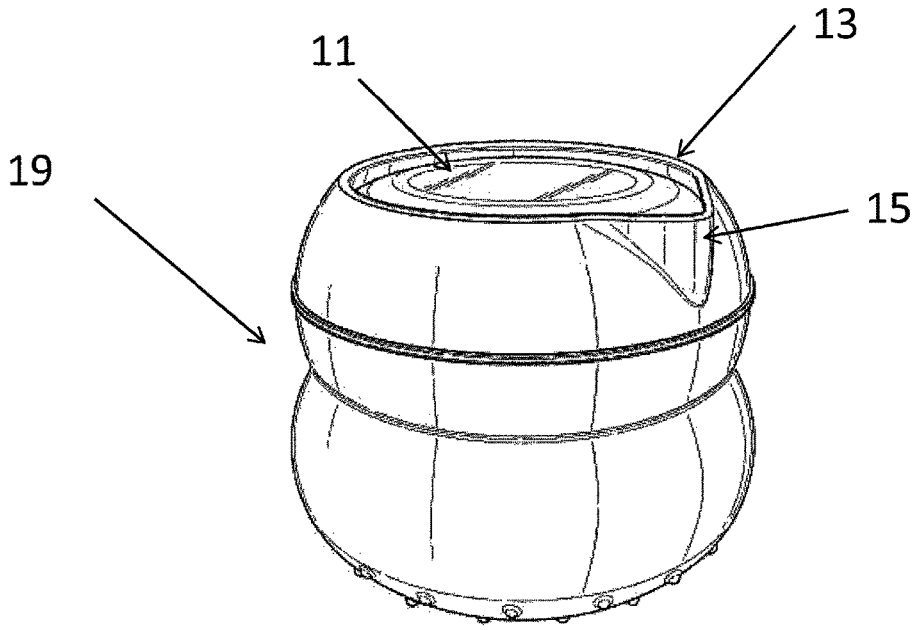

Various non-limiting embodiments of the invention will now be more particularly described with reference to the following figures in which:

FIG. 1 shows a perspective view of a fabric stain treatment device according to the invention FIG. 2 shows a side view of the fabric stain treatment device of FIG. 1.

Referring to the drawings, a fabric stain treatment device 1 is shown for treating a stain on a fabric (not shown) with a fabric stain treatment composition (not shown) during a fabric washing process, the fabric stain treatment device comprising:

(a) a storage chamber 7 for storing the fabric stain treatment composition, said storage chamber 7 comprising a waist portion 9;

(b) a filling and dispensing aperture 11 defined by a circular (in plan view) upper edge portion 13 of the storage chamber 7, said edge portion/s 13 comprising a pour spout 15; and (c) at least one annular scrubbing portion 17.

The storage chamber 7 comprises two adjacent convex walls 3 and 5 in a stacked arrangement, comprising an upper wall 3 and an lower wall 5 (when the device is observed on a level surface).

As can be seen, the walls 3, 5 are stacked so that upper wall portion 3 is on top of the other lower wall portion 5 in upright orientation when the fabric stain treatment device 1 as shown in level orientation i.e. placed with its base on a substantially level surface.

The upper and lower walls 3, 5 have substantially common convex curvature when viewed from a side (FIG. 2). These adjacent walls 3,5 converge to co-join each other thereby defining a curved cleft indentation 9 in at least the outer surface of the storage chamber 7 (when viewed from the side) thereby providing said waist portion 19.

With such an arrangement, the general outer shape of the fabric treatment device 1 appears as two stacked and aligned (longitudinally), truncated spheres wherein said truncation is by removal of opposing upper and lower spherical caps corresponding to walls 3 and 5 respectively.

The fabric stain treatment device is generally symmetrical about any upright plane passing through the longitudinal axis of the device. It may also be symmetrical about a level plane passing through the cleft (or in the case of a cusp, through the above mentioned common tangent).

The cleft has an apex or point referenced 9. In another embodiment (not shown), the cleft is more deeply curved such that the co-joining is at a cusp. The cusp, when viewed from the side, preferably comprises a point or portion where the curves of each of said wall portion share or tend toward a common level tangent. When viewed from the side with the device on a level surface the common tangent is level.

The fabric stain treatment device 1 comprises a resilient e.g. elastomeric material or the like, to enhance the gripping action afforded by the stacked walls 3,5.

Preferably the storage chamber 7 comprises an inner surface of the fabric stain treatment device 1 which mirrors the outer surface. In the case of stacked convex walls 3,5 as shown in this example, the advantage is that the inner surfaces are concave relative to any stored composition and so act to contain the composition. Preferably there is at least one internally projecting edge portion (not shown) provided by the cleft 9. This assists in deflecting any fluid back into the device during pretreatment when the device is tipped/moved back and forth in scrubbing. Preferably there is a second internally projecting edge portion in the at least one upper wall which even further enhances the anti-spillage performance of the device. In this example the upper edge portion 13 provides the projecting edge portion.

The device 1 shown here is translucent. This allows more light into parts of the interior of the device which have diminished direct light e.g. around the internally projecting edge portion so that the fill-level of the stored composition can be ascertained.

The fabric treatment device 1 comprises a base whose position is generally indicated by arrow referenced 21, contiguous with the lower wall 5; said base 21 and lower wall interconnecting at a base edge portion 23. The base edge portion 23 extends annularly around the device.

The annular scrubbing portion 17 in this example extends to the lower wall 5 and the base portion 21.

The annular scrubbing portion 17 comprises regularly spaced projections, having proximal (end nearest the device) and distal (end furthest from the device) portions. Each projection is circular in plan view and tapers (narrows) in the direction of the distal portion.

Base 21 comprises a concave central portion (viewed externally of the device) such that the base edge portion 23 is more defined visually and/or structurally. The concave base portion (not shown) has a smooth surface.

In use, the fabric stain treatment device 1 is used to treat stains with a fabric stain treatment device on a fabric during a fabric washing process as follows:

(a) the user charges with a fabric stain treatment composition, the stain treatment device 1 where it is stored in the storage chamber 7;

(b) the user then pours a portion of the stored fabric stain treatment composition from the stain treatment device via the pour spout 15 on to a fabric stain;

(c) holding the stain treatment device 1 at the waist 19 and tilting the device 1 the user scrubs the fabric with the projections on annular scrubbing portion 17;

(d) the device is placed with the fabric into a washing machine to undergo a washing process therein.

During this process, the curved cleft is advantageous in that, as the users' fingers intuitively grasp the waist portion they are encouraged by the curvature at the area of the cleft 9 to move toward the apex (shown by the point of the reference arrow in FIG. 1) and the convexity of the two walls 3, 5 provides a gripping action which acts against release or slide from the holding position. This helps in wet/slippery conditions as is often the case in a domestic laundering situation especially pretreatment.

The annular scrubbing portion 17 being provided on this circumferential edge portion 23 extends around the entire circumference so scrubbing may effected by any part of the edge. The provision of an edge scrubbing feature allows precise scrubbing as can be required with small food stains. This is especially advantageous for minor (small) stains which have red colouration. Minor stains of lighter colours are easier dealt with and less dramatic. However one single red-coloured stain can entirely ruin a whole white garment. The device affords precise treatment of small, red-coloured food stains without the need for a separate, dedicated often expensive stain treatment device such as a stain pen.

The presence of the or each annular scrubbing portion on the circumferential edge portion allows for a small amount of tilting of the device to bring the scubbing portion into play. It also however allows for no or at least minimal scrubbing when the device is not tilted but held level. It also restricts scrubbing to that part of the fabric that the user can actually see whilst scrubbing, should the user want to scrub only the parts of the fabric bearing the stain.

The concave base portion (not shown) has a smooth surface. This also can restrict unwanted, excessive scrubbing by also having scrubbing portions on the base portion.

Unless stated otherwise, all proportions are given in weight percent by weight of the total fluid.

Exemplary Fabric Treatment (Washing) Liquid

| Ingredient as 100% active | Wt % |
|---|---|
| Neodol 25-9* | 6-8 |
| Alcohol ethoxy sulfate | 12-15 |
| Linear alkylbenzene sulfonate | 6-9 |
| Sodium citrate, dihydrate | 3-6 |
| Propylene glycol | 4-8 |
| Sorbitol | 3-6 |
| Sodium tetraborate pentahydrate | 2-4 |
| Volatile benefit agent: perfume | |
| Enzymes | 2 |
| Minor additives and water | to 100% |

*$C_{12}$-$C_{15}$ alkoxylated (9EO) chain group

The invention claimed is:

1. A fabric stain treatment device for treating a stain on a fabric with a fabric stain treatment composition during a fabric washing process, the fabric stain treatment device comprising:

a storage chamber for storing the fabric stain treatment composition, the storage chamber comprising:

two adjacent convex walls in a stacked arrangement with an upper wall and a lower wall;

a waist portion;

a top surface; and an upper edge portion protruding from the top surface;

a filling and dispensing aperture disposed on the top surface and circumscribed by the upper edge portion;

a pour spout defined by the upper edge portion and configured to receive the fabric stain treatment composition from the filling and dispensing aperture;

a base comprising a periphery which is contiguous with the lower wall, the base and lower wall interconnecting at a base edge portion; and an annular scrubbing portion contiguous with the base edge portion;

wherein the upper edge portion and the top surface are configured to cooperate to collect the fabric stain treatment composition from the filling and dispensing aperture and direct the fabric stain treatment composition to the pour spout.

2. The device of claim 1, wherein the upper and lower walls have a substantially common convex curvature.

3. The device of claim 1, wherein the adjacent walls converge to co-join each other thereby defining a curved cleft indentation in at least the outer surface of the storage chamber thereby providing the waist portion.

4. The device of claim 1, wherein the storage chamber comprises an inner surface of the fabric stain treatment device which mirrors the outer surface and there is at least one internally projecting edge portion provided by the cleft.

5. The device of claim 1, wherein the base comprises a central concave portion.

6. The device of claim 1, further comprising a unit dose of the fabric stain treatment composition.

7. The device of claim 1, wherein the fabric stain treatment composition comprises one or more enzymes.

8. The device of claim 7, wherein the one or more enzymes comprises a pectate lyase enzyme.

9. The device of claim 7, wherein the one or more enzymes further comprises one or more enzymes selected from: protease, lipase, phospholipase, amylase, cutinase, cellulose, mannanase, peroxidise, and oxidase.

10. A process for treating fabric stains with a fabric stain treatment composition during a fabric washing process comprising the steps of:

(a) charging with the fabric stain treatment composition, the stain treatment device according to claim 1;

(b) pouring at least a portion of the fabric stain treatment composition from the stain treatment device on to a fabric stain via the pour spout;

(c) holding the stain treatment device at the waist portion and scrubbing the fabric with the annular scrubbing portion and then optionally, (d) placing the device and the remaining composition and the fabric into a washing machine to undergo a washing process therein.

11. A process according to claim 10 comprising the step of tilting the stain treatment device prior to and/or during the step (c) of scrubbing the fabric.

12. A fabric stain treatment kit comprising:

(a) a fabric stain treatment composition comprising one or more enzymes;

(b) a fabric stain treatment deice comprising:

a storage chamber for storing the fabric stain treatment composition, the storage chamber comprising:

two adjacent convex walls in a stacked arrangement with an upper wall and a lower wall;

a waist portion;

a top surface; and an upper edge portion protruding from the top surface;

a filling and dispensing aperture disposed on the top surface and circumscribed by the upper edge portion;

a pour spout defined by the upper edge portion and configured to receive the fabric stain treatment composition from the filling and dispensing aperture;

a base comprising a periphery which is contiguous with the lower wall, the base and lower wall interconnecting at a base edge portion; and an annular scrubbing portion contiguous with the base edge portion;

wherein the upper edge portion and the top surface are configured to cooperate to collect the fabric stain treatment composition from the filling and dispensing aperture and direct the fabric stain treatment composition to the pour spout; and (c) instructions to treat a fabric stain using the device and the composition, the instructions including the steps of:

charging the device with the composition;

pouring at least a portion of the composition from the device on to a fabric stain via the pour spout;

holding the device at the waist portion and scrubbing the fabric with the annular scrubbing portion and then optionally, placing the device and the remaining composition and the fabric into a washing machine to undergo a washing process therein.

* * * * *